US010174615B2

(12) United States Patent
Liotard et al.

(10) Patent No.: US 10,174,615 B2
(45) Date of Patent: Jan. 8, 2019

(54) CUTTER HOLDER FOR A TUNNEL BORING MACHINE AND AN ASSOCIATED CUTTING SET

(71) Applicant: BOUYGUES TRAVAUX PUBLICS, Guyancourt (FR)

(72) Inventors: Philippe Liotard, Mornans (FR); Patrice Robert, Bezons (FR)

(73) Assignee: BOUYGUES TRAVAUX PUBLICS, Guyancourt (FR)

( * ) Notice: Subject to any disclaimer, the term of this patent is extended or adjusted under 35 U.S.C. 154(b) by 36 days.

(21) Appl. No.: 15/033,857

(22) PCT Filed: Nov. 4, 2014

(86) PCT No.: PCT/EP2014/073690
§ 371 (c)(1),
(2) Date: May 2, 2016

(87) PCT Pub. No.: WO2015/063322
PCT Pub. Date: May 7, 2015

(65) Prior Publication Data

US 2016/0273358 A1 Sep. 22, 2016

(30) Foreign Application Priority Data

Nov. 4, 2013 (FR) ..... 13 60802

(51) Int. Cl.
*E21D 9/10* (2006.01)
*E21B 10/20* (2006.01)

(52) U.S. Cl.
CPC ..... *E21D 9/1006* (2013.01); *E21D 9/104* (2013.01); *E21B 10/20* (2013.01); *E21D 9/10* (2013.01)

(58) Field of Classification Search
CPC .... E21D 9/08; E21D 9/10; E21D 9/11; E21D 9/104; E21B 10/10; E21B 10/12; E21B 10/20
USPC ..... 405/138; 299/55, 58; 175/373; 29/426.1
See application file for complete search history.

(56) References Cited

FOREIGN PATENT DOCUMENTS

| | | | |
|---|---|---|---|
| CA | 2785364 | A1 * | 6/2011 |
| FR | 2758853 | | 7/1998 |
| FR | 2758853 | A1 * | 7/1998 |
| JP | H07180488 | | 7/1995 |
| JP | 10140980 | A * | 5/1998 |

(Continued)

OTHER PUBLICATIONS

French Search Report dated Jun. 30, 2014, French Application No. 1360802.

*Primary Examiner* — Sunil Singh
(74) *Attorney, Agent, or Firm* — Womble Bond Dickinson (US) LLP

(57) ABSTRACT

The invention relates to a cutter holder (1) for a tunnel boring machine, comprising:
- a housing (2) comprising two cavities (26) formed in opposite walls (20), and
- two clamping sets (3), configured to be removably mounted on either side of the roller cutter (10) in the housing (2), and each comprising:
- a base plate (32), and
- a center wedge (34), movably mounted on the base plate (32),
- two side wedges (36), hinged between the base plate (32) and the center wedge (34) between a retracted position and a clamping position, wherein the side wedges (36) transversely swing and enter into the cavity (26) facing the housing (2).

11 Claims, 5 Drawing Sheets

(56) References Cited

FOREIGN PATENT DOCUMENTS

| | | |
|---|---|---|
| JP | H10140980 | 5/1998 |
| JP | 2007070825 | 3/2007 |
| WO | WO-2011076616 | 6/2011 |

* cited by examiner

CUTTER HOLDER FOR A TUNNEL BORING MACHINE AND AN ASSOCIATED CUTTING SET

FIELD OF THE INVENTION

The invention relates to a cutting set for a tunnel boring machine including a tunnel boring machine roller cutter, a method for replacing a tunnel boring machine roller cutter on the cutting head of a tunnel boring machine suitable for such a cutter holder as well as a handling device for the holder cutter.

TECHNOLOGICAL BACKGROUND

Tunnel digging machines or tunnel boring machines are known, which comprise a movable structure having large dimensions which is called a shield, having a substantially circular cross-section the diameter of which corresponds to the diameter of the tunnel the digging of which is made.

A roller cutter, or cutting disk, is a cutting tool freely revolving around a shaft attached to the cutting head of a tunnel boring machine. During rotation of the head and under the influence of thrust, the roller cutter rolls over the cutting face and chips out the rock in the form of scale-like plates.

Thus, the cutting head includes a plurality of roller cutters evenly distributed over its surface.

Conventionally, the roller cutters are mounted within a cutter holder on the cutting head by means of bolts. For this, the cutter holder comprises a housing, adapted to be attached to the tunnel boring machine shield and defining a chamber arranged to accommodate the roller cutter. Tightening supports are attached on or formed with outer faces of the roller cutter and comprise two blocking surfaces adapted to engage with a manual locking system. This locking system comprises in particular wedges, adapted to engage between cavities of the housing and blocking surfaces of the tightening supports. These wedges are attached in position in the cavities using several screws, bolts, etc. in order to prevent the roller cutters from being moved out from the housing, in spite of the harsh operating environment of the roller cutter.

The problem of changing the roller cutters occurs particularly in the case of a confined face tunnel boring machine, because access to the cutting head and to the roller cutter attachments (wedges, screws, etc.) is difficult and the working environment is under hyperbaric conditions. In such tunnel boring machines, the changing of the roller cutter is carried out, for safety reasons, from the rear of the cutting head, that is the side of the cutting head opposite the cutting face.

The procedure for changing a roller cutter often demands the exertion of considerable forces for loosening the used roller cutter from its housing, due to jams and the absence of guidance for the roller cutter, which is poorly compatible with work under hyperbaric conditions.

At present, the procedure for changing a roller cutter consists in equipping the roller cutter with lifting eyes, lifting it using a pulley block running along a rail, to load it onto a cart running through the equipment airlocking and bringing it back to the rear inside the shield, at atmospheric pressure. During dismantling, it is also necessary to progressively collect all the elements (wedges, screws, bolts, etc.) necessary for mounting the roller cutter and which will be used for mounting the new roller cutter.

Before inserting the new roller cutter in its housing, it must be properly positioned, which requires a painstaking manual intervention. Once the roller cutter is pushed towards its operating position, several blocking wedges are then put in place. Documents JP H10 140980, JP 2007/070825, JP H07 180488 and FR 2 758 853, could in particular be referred to, which describe cutting tools comprising roller cutters attached in a housing on the cutting head using wedges held fixed in position with respect to the housing by means of bolts, screws and/or journals.

It will be understood therefore that this procedure is long and tedious for the operators.

Thus, it has been provided in document WO 2011/076616 on behalf of the applicant, a new roller cutter comprising a locking member adapted to be immobilized in the housing, such that the roller cutter makes up a rigid block in view of the handling thereof, and means for prestressing the roller cutter that can include integrally borne screws of the roller cutter. In a particular embodiment, the locking member includes a bayonet adapted to cooperate with a cavity of the housing and rotatably movable between a position of inserting the roller cutter in the housing and a position of locking the roller cutter in the housing.

However, in use, the roller cutter undergoes very high pressure and vibration stresses which might move out the bayonet. Indeed, it is difficult to apply a prestressed strain enough to resist the vibrations of the roller cutter in a hard field.

SUMMARY OF THE INVENTION

One purpose of the present invention is thus to provide a cutter holder and a cutting set for a tunnel boring machine comprising a tunnel boring machine roller cutter and an associated cutter holder, capable of supporting the very harsh environment of the roller cutters, in particular the high pressure and vibrations generated by rolling the roller cutter on the cutting face, and which further allow any human intervention upon replacing one roller cutter to be reduced, or even suppressed.

Another purpose of the invention is to provide a method for replacing a roller cutter of such a cutting set, as well as a handling device for the roller cutter adapted to implement this method, by enabling in particular any loss of parts to be avoided.

Also, the handling device of the cutting set must be easy to clean and not include any areas that retain water or mud.

Finally, this device must be usable in existing cutting heads, preferably without requiring significant modifications to the same.

For this, the invention provides a cutter holder for a tunnel boring machine, said cutter holder being adapted to accommodate a roller cutter freely rotatably mounted about an axis of rotation in said cutter holder and comprising:

a housing, defining a chamber arranged to accommodate the roller cutter, said housing comprising two cavities formed in opposite walls of the chamber, and two clamping sets, configured to be removably mounted on either side of the roller cutter in the housing, and each comprising a base plate, adapted to be attached to the roller cutter in the housing, said roller cutter remaining rotatably free about its axis of rotation, and a centre wedge and two side wedges, the cutter holder being characterised in that, for each clamping set, the centre wedge is movably mounted on the base plate and in that both side wedges are mounted on the base plate and the centre wedge by being hinged thereto between a retracted position, wherein the side wedges are retracted and enable the clamping set to be removed from the housing, and a clamping position, wherein the side wedges swing and fit into the cavity facing the housing in order to prevent the clamping set from being extracted from the housing.

Some preferred but not limiting characteristics of the cutter holder described above are the following:

each clamping set further comprises a stud bolt, mounted on the base plate, and an actuating nut, mounted on the one hand on the centre wedge and on the other hand on the stud bolt, such that screwing or unscrewing said actuating nut causes the translation of the centre wedge with respect to the base plate and the side wedges to be moved between their retracted position and their clamping position, the side wedges are rotatably mounted about an axis on the base plate or on the centre wedge, and each comprise an actuating pin, and two guide grooves are formed in the centre wedge or in the base plate respectively, said guide grooves defining cam surfaces for the actuating pins, each actuating pin being accommodated in a guide groove such that the movement of the centre wedge with respect to the base plate causes the movement of the actuating pin along the guide groove and thus the rotation of the side wedge with respect to the base plate between its retracted position and its clamping position, the side wedges are rotatably mounted on the base plate and the guide grooves are formed in the centre wedge, the axis of rotation of the side wedges is substantially parallel to the axis of rotation of the roller cutter, the side wedges and the centre wedge comprise associated pressing faces, configured to be engaged when the side wedges are in the clamping position in order to withstand strains passing through the clamping sets and provide a stable state to said clamping sets, the side wedges extend substantially symmetrically with respect to the base plate, the housing further comprises four further cavities each respectively in the opposite side walls between the cavities and the front face of the housing, adapted to each receive a further side wedge distinct from the clamping sets.

According to a second aspect, the invention also provides a housing for a cutter holder for a tunnel boring machine as described above, comprising side walls and a front face, from which the roller cutter projects, defining together a chamber arranged to accommodate the roller cutter, the housing being characterised in that it comprises two cavities formed in opposite side walls of the chamber, and adapted to be engaged with the side wedges when said side wedges are in their clamping position in order to prevent the clamping sets from being extracted from the housing.

Some preferred but not limiting characteristics of the housing are the following:

it further comprises at least four further cavities respectively formed in the opposite side walls between the cavities and the front face of the housing and adapted to each receive a further side wedge distinct from the clamping sets, and it further comprises a side wedging system, attached to one of the opposite side walls of the chamber, adapted to apply a side strain to the housing.

According to a third aspect, the invention also provides a clamping set of a cutter holder for a tunnel boring machine such as described above, configured to be removably mounted on either side of a roller cutter in a housing, and each comprising:

a base plate, adapted to be attached to the roller cutter (10) in the housing, said roller cutter remaining rotatably free about its axis of rotation, and a centre wedge and two side wedges, the clamping set being characterised in that the centre wedge is movably mounted on the base plate and in that both side wedges are mounted on the base plate and the centre wedge by being hinged thereto between a retracted position, wherein the side wedges are retracted and enable the clamping set to be removed from the housing (2), and a clamping position, wherein the side wedges (36) swing and fit into the cavity (26) facing the housing in order to prevent the clamping set from being extracted from the housing.

According to a fourth aspect, the invention also provides a cutting set for a tunnel boring machine, comprising a roller cutter, attached in a cutter holder as described above.

According to a fifth aspect, the invention also provides a method for replacing a roller cutter of a cutting set for a tunnel boring machine as described above, characterised in that it comprises the steps of:

(i) extracting a used roller cutter from the housing, comprising the following steps of:

docking and clamping on the housing of a handling device adapted for grasping and guiding the roller cutter, grasping the clamping set and/or the roller cutter by the handling device, releasing the clamping applied to the clamping set and the housing, extracting the roller cutter from the housing, removing the handling device from the housing, (ii) installing in said housing a replacement roller cutter, comprising the following steps of:

grasping the clamping set and/or the roller cutter by the handling device, docking and clamping the handling device on the housing, inserting the roller cutter into the housing, said roller cutter being guided by the handling device, operating the clamping set of the roller cutter, so as to accommodate the wedge in the cavity of the housing.

BRIEF DESCRIPTION OF THE DRAWINGS

Further characteristics, purposes and advantages of the present invention will better appear upon reading the detailed description that follows, and with regard to the appending drawings given by way of non-limiting examples and in which.

DETAILED DESCRIPTION OF AN EMBODIMENT

Figure 1:
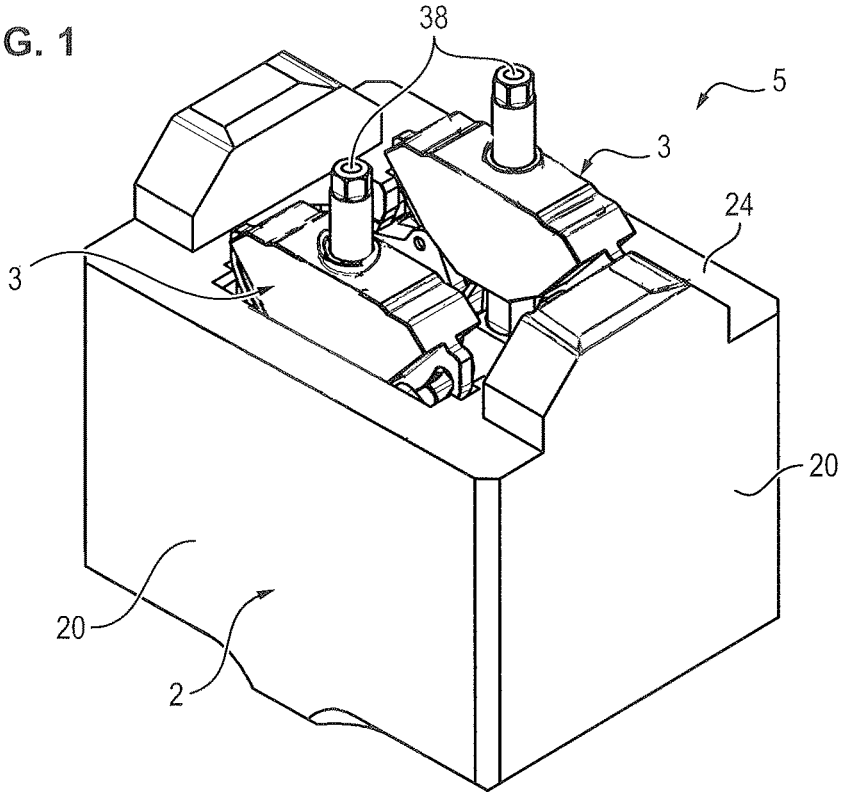
FIGS. 1 and 2 are perspective views under different angles of an exemplary embodiment of a tunnel boring machine cutting set in accordance with the invention.
Figure 2:
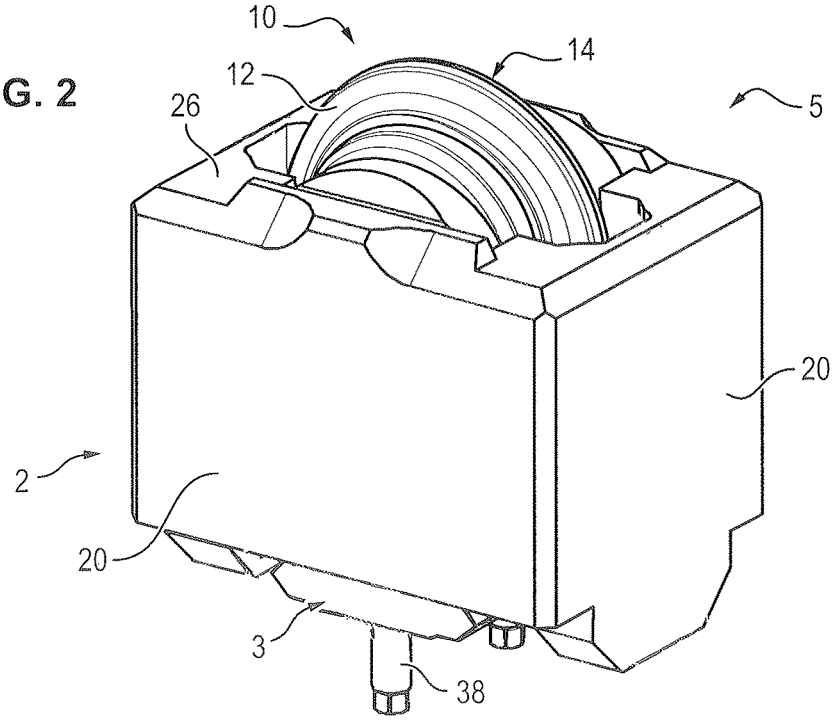
Figure 3:
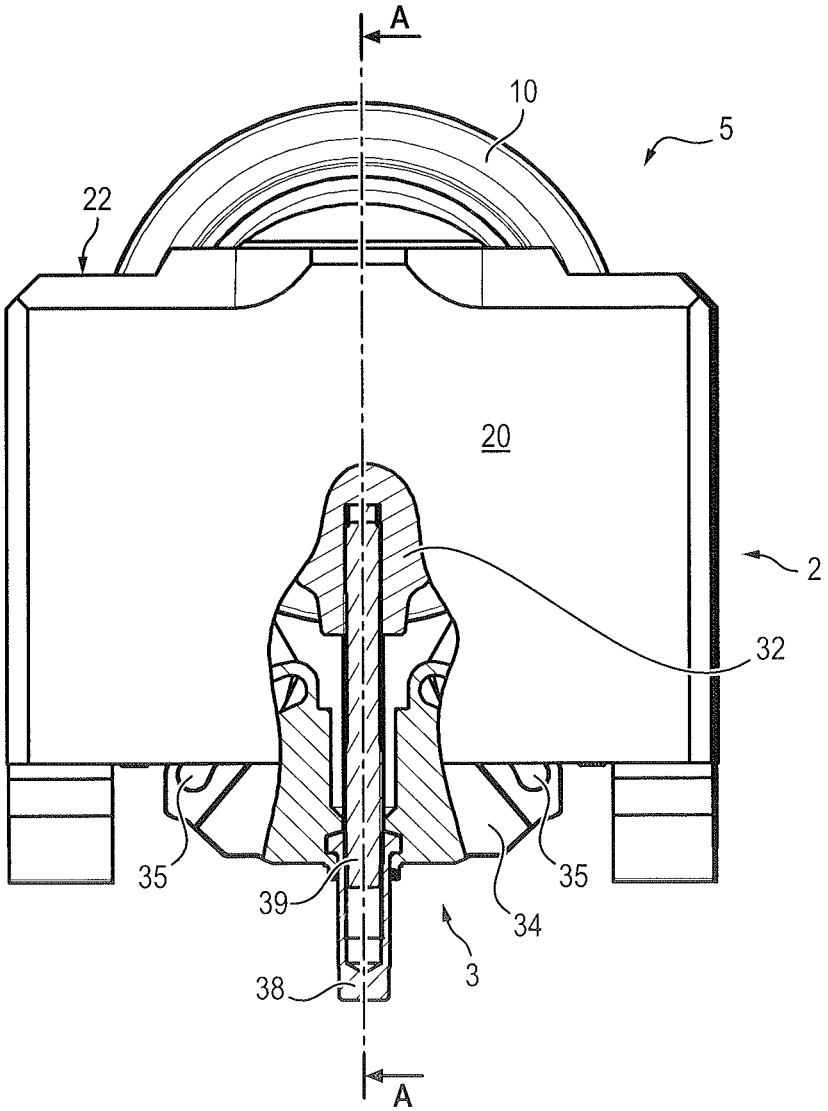
FIG. 3 is a partly truncated side view of the cutting set of FIGS. 1 and 2.

A cutting assembly 5 comprises a cutter holder 1 for a tunnel boring machine and a roller cutter 10 housed in the holder 1.

A roller cutter 10 presents, in a known manner, the general shape of a disk comprising two side faces connected by a substantially circular section 14. During rotation of the head of the tunnel boring machine and under the influence of thrust, the section 14 of the roller cutter 10 rolls over the cutting face and chips out the rock, forming scale-like plates.

The roller cutter 10 is mounted in a holder 1 so as to be free to move in rotation around its rotation axis X.

For this purpose, the holder 1 comprises a housing 2, designed to be fastened onto a tunnel boring machine shield and two clamping assemblies 3 mounted on either side of the roller cutter 10 in a removable manner in the housing 2 to clamp the roller cutter 10 inside said housing 2.

The housing 2 comprises side walls 20 connected by a front face 22 and a rear face 24 and together defining a chamber 21 designed to accommodate a roller cutter 10. The front face 22 is defined as being the face from which the roller cutter 10 protrudes towards the cutting face, whereas the rear face 24 of the housing 2 is the opposite face, through which the roller cutter 10 is inserted.

The housing comprises two contact surfaces 26 formed in the opposite side walls 20, configured to move opposite the side faces 12 of the roller cuter 10 when the roller cutter 10 is inserted in the chamber 21 of the housing. These two opposite side walls 20 are also crossed by the drive shaft (not illustrated in the figures) of said roller cutter 10 to allow for its rotation in relation to the housing 2.

Each clamping assembly 3 comprises a base plate 32, configured for assembly on the roller cutter 10 in the housing 2, while allowing for free rotation around its rotation axis X, a mobile central wedge 34 assembled on the base plate 32 and two side wedges 36. The side wedges 26 are articulated between the base plate 32 and the central wedge 34 between a retracted position, wherein the side wedges 36 retract, and a clamping position, wherein the side wedges 36 move transversally and engage in the contact surface 26 facing the housing 2 in order to prevent extraction of the clamping assembly 3 from the housing 2.

In the embodiment example illustrated in the figures, the side wedges 36 are mounted by rotation on the base plate 32 around an axis Y substantially parallel to the rotation axis X of the roller cutter 10. The side wedges 36 are therefore bonded to the base plate 32 at all times. Bonded is understood as meaning that the different elements are mechanically connected, i.e. that they can move in relation to each other however stay mechanically connected to each other without any natural possibility of separation. In a general manner, all parts forming the clamping assembly 3 are bonded to each other, either directly or indirectly, in order to enable the clamping assembly 3 to be manipulated by an automated handling device. The parts forming the clamping assembly 3 are therefore captive, which significantly simplifies the implementation of such a handling device.

The base plate 32 can be fastened to the side face 12 of the roller cutter 10 using screws. Furthermore, the central wedge 34 can move in translation in relation to the base plate 32 and is designed to move the side wedges 36 between the retracted position and their clamping position according to kinematics designed to ensure that the roller cutter 10 is locked in the housing 2 and vice versa.

In one embodiment, in order to move the side wedges 36 between their retracted position and their clamping position, each clamping assembly 3 comprises an actuating pin 37, bonded to each side wedge 36 and housed in a guide groove 35 formed in the central wedge 34 so as to be mobile along said guide groove 35. For example, the actuating pins 37 can be entirely formed with the corresponding side wedge 36.

Figure 4A:
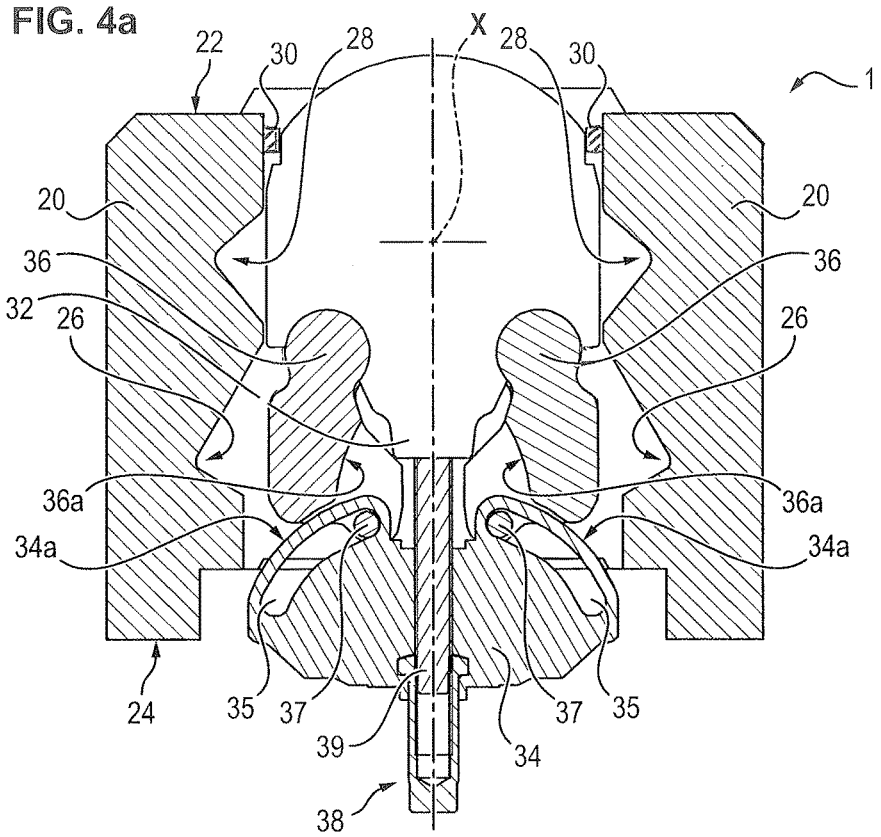
FIG. 4*a* is a cross-section view of a first exemplary embodiment of a cutter holder for the tunnel boring machine according to the invention, in the retracted position (ready for extraction)
Figure 4B:
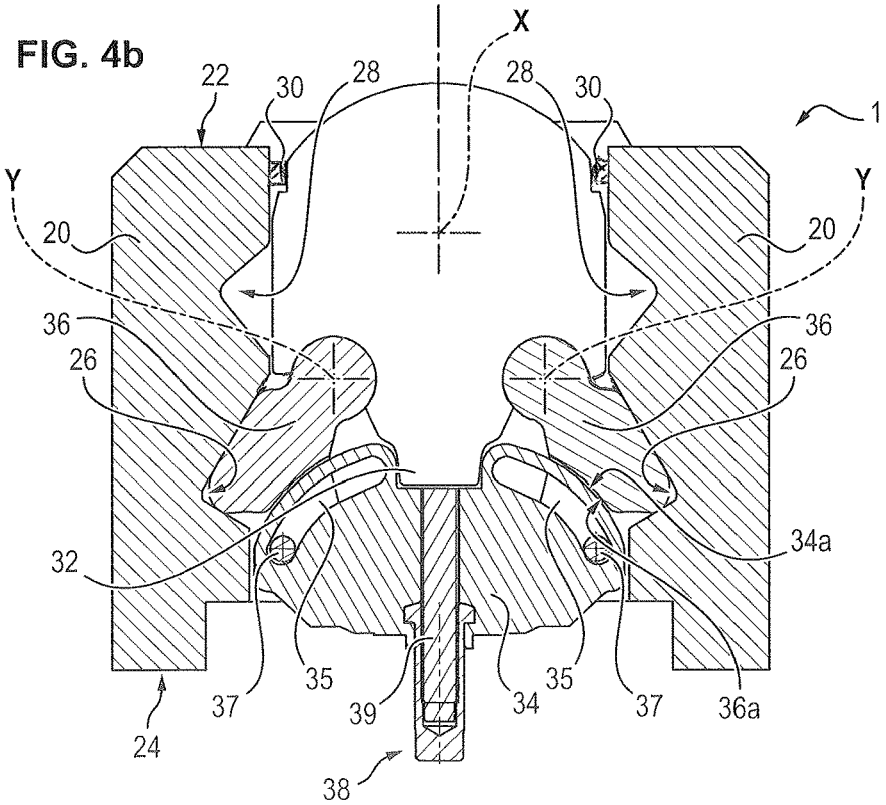
FIG. 4*b* is a cross-section view of the cutter holder of FIG. 4*a*, in the clamping position.

In the embodiment example illustrated in FIGS. 4*a* and 4*b*, the guide grooves 35 are curved in shape so as to each define two cam surfaces for the corresponding actuating pin 37. Therefore, during passage from the retracted position to the clamping position, the central wedge 34 is moved towards the base plate 32, which moves the actuating pins 37 along a first wall of the guide grooves 35, preferably according to an arc centred on the Y axis. The side wedges 36 therefore move transversally in order to become engaged in the contact surface 26 opposite the housing, and thus prevent the extraction of the clamping assembly 3 from the housing 2.

Conversely, during passage from the clamping position to the retracted position, the central wedge 34 is moved away from the base plate 32, which moves the actuating pins 37 along a second wall of the guide grooves 35, preferably according to an arc centred on the Y axis. The side wedges 36 thus retract by moving closer to each other and exit the contact surface 26, thus releasing the clamping assembly 3 and therefore the roller cutter 10 from the housing 2.

In one embodiment, the side wedges 36 and the central wedge 34 of each clamping assembly 3 comprise associated support surfaces 36*a*, 34*a*, configured to come together when the side wedges 36 are in the clamping position. For this purpose, the support surfaces 36*a*, 34*a* of the side wedges 36 and of the central wedge 34 are adapted and oriented to support the stresses travelling through the clamping assemblies 3 and forming a stable state for said clamping assembly 3. A stable state is understood in that the support surfaces 34*a*, 36*a* remain in contact despite the strong vibrations and high pressure to which the cutting assembly 5 is subject and only disengage on application of a stress on the actuator 38 in order to retract the side wedges 36. Therefore, when the side wedges 36 are in their clamping position, the loading stresses are distributed between the two side wedges 36 and cannot be transferred to one of the two side wedges 36 alone. Furthermore, in the clamping position, the cooperation of the support surfaces 36*a*, 3*aa* of the side wedges 36 and the central wedge 34 prevents the loading stresses generated by the harsh environment of the cutting assemblies 5 from travelling through the actuating pins and guide grooves 35. The cam effect between the actuating pins 37 and the guide grooves 35 therefore becomes inoperative when the side wedges 36 are in the clamping position, as the support surfaces 34*a*, 36*a* of the central wedge 34 and the side wedges 36 support the loading stresses.

It is understood that the invention also covers the case of an equivalent clamping assembly 3, wherein the side wedges 36 are mounted bonded to each other and free to rotate on the central wedge 34, where the guide grooves 35 forming the cam surfaces are formed in the base plate 32. Translation of the central wedge 34 therefore drives the movement of the actuating pins 37 along the guide grooves 35, preferably according to arcs centred on the Y axis, and therefore the rotation of the side wedges 36 in relation to the central wedge 34 between their retracted position and their clamping position.

In order to move the central wedge 34 in relation to the base plate 32, the clamping assembly 3 also comprises an actuator 38 mounted on the base plate 32 and the central wedge 34.

For example, the actuator can comprise a stud bolt 39 anchored in the base plate 32 at the free end from which an actuating nut 38 is screwed, in this case a flange nut. The nut 39 is also mounted on the central wedge 34 so as to be bonded in translation to the latter. The screwing/unscrewing of the nut 38 on the stud bolt 39 therefore drives the movement of the nut along the stud bolt 39 and therefore that of the central wedge 34 in relation to the base plate 32. Preferably, the tightening torque on the nut 38 applies enough stress on the side wedges 36 to block the roller cutter 10 in relation to the housing 2 during its digging work, despite the harsh environment to which the cutting assembly 5 is subjected.

This embodiment example of the actuator 38 is in no way limitative; other types of actuators 38 capable of controlling the translation of the central wedge 34 in relation to the base plate 32 while maintaining the roller cutter 10 in position at the end of its travel may also be considered. This may, for example, be a hydraulic cylinder.

Figure 5:
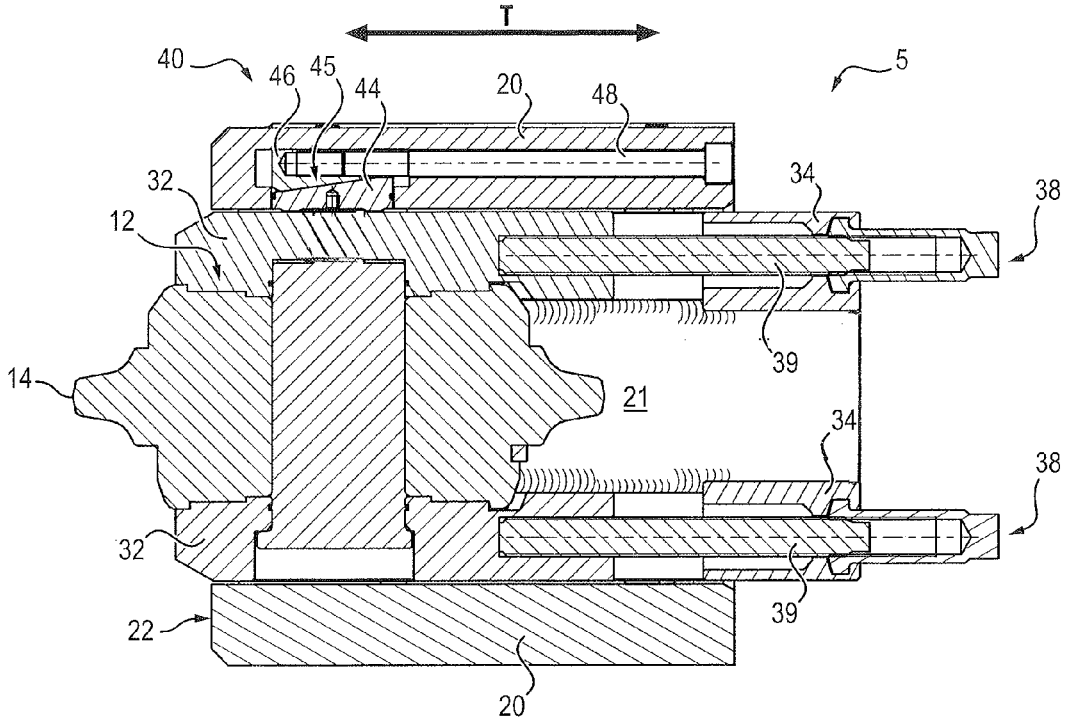
FIG. 5 is a cross-section view along the axis A-A of the cutting set of FIGS. 1 and 2.

In one alternative embodiment illustrated in FIG. 5, the housing 2 also comprises a side wedging system 40 designed to adjust the wedging of the roller cutter 10 and the clamping assemblies 3 in the housing 2 along the rotation axis X of the roller cutter 10. This side wedging system 40 comprises a housing 42, related to one of the side walls 20 of the housing 2 and comprising a recess in which two corners 44, 46 are housed, connected together by a dovetail. A first corner 44 is attached to the side wall 20 of the housing 2 and is therefore immobile in relation to the latter, whereas the second corner 46 is capable of sliding along a surface 45 of the first corner 44, which forms a cam surface. Preferably, the dimensions of the corners 44, 46 are such that the second corner 46 is blocked in a direction perpendicular to the side wall 20, however mobile in a direction of translation T substantially parallel to the latter. A screw 48 extending along the direction of translation T, is also attached to the second corner 46. The screwing of the screw 48 therefore drives the movement of the second corner 46 towards a working position of the corner, wherein the corners 44, 46 apply stress perpendicularly to the side wall 20 of the housing 2 and a retracted position, wherein the corners 44, 46 are at rest.

Alternatively, the screw 48 could be replaced by a supporting finger equipped with a spring.

Figure 6:
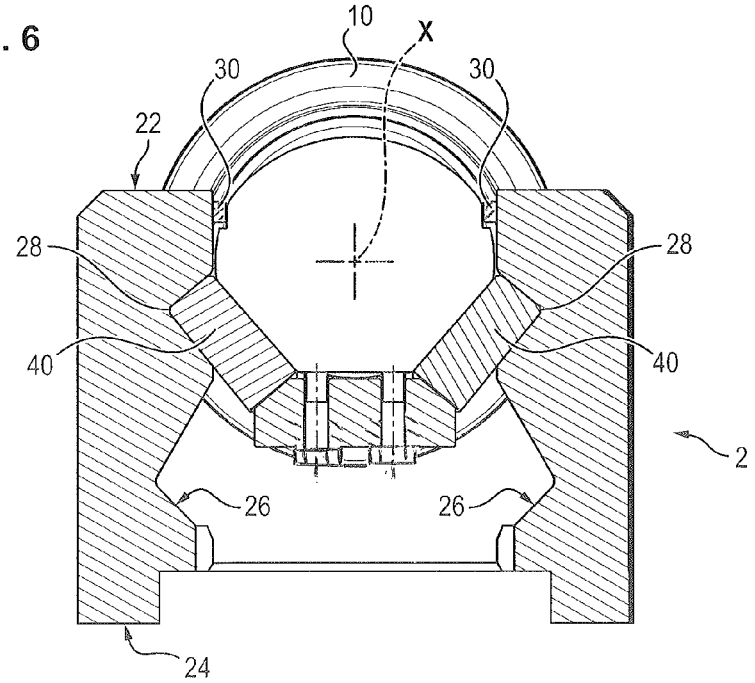
FIG. 6 is a cross-section view of an exemplary embodiment of a housing according to the invention for a tunnel boring machine cutting set, wherein the roller cutter is clamped, for example by a conventional locking system.

The housing 2 of the cutting assembly 5 can also be configured in such a manner as to enable the clamping of the roller cutter 10 using a standard manual locking system. For this purpose, the housing 2 must comprise, in the inner surface of the opposite side walls 20 in which the contact surfaces 26 are formed, two additional contact surfaces 28. The additional contact surfaces 28 are preferably formed between the contact surfaces 26 intended to accommodate the side wedges 36 of the clamping assemblies 3 and the front face 22. As shown in FIG. 6, each additional contact surface 28 is designed to house an additional side wedge 40 of the manual locking system, different from the clamping assemblies 3. The additional side wedges 36 are therefore maintained in the additional contact surfaces 28 using an additional central wedge screwed in a standard screwing support, itself attached to the side face 12 of the roller cutter 10.

The cutter holder 1 according to the invention therefore enables a roller cutter 10 to be clamped in a simple, fast, inexpensive and automated manner, without modifying the roller cutter 10. Where applicable, the housing of the holder 1 can also be used to clamp the roller cutter 10 using standard systems.

Figure 7:
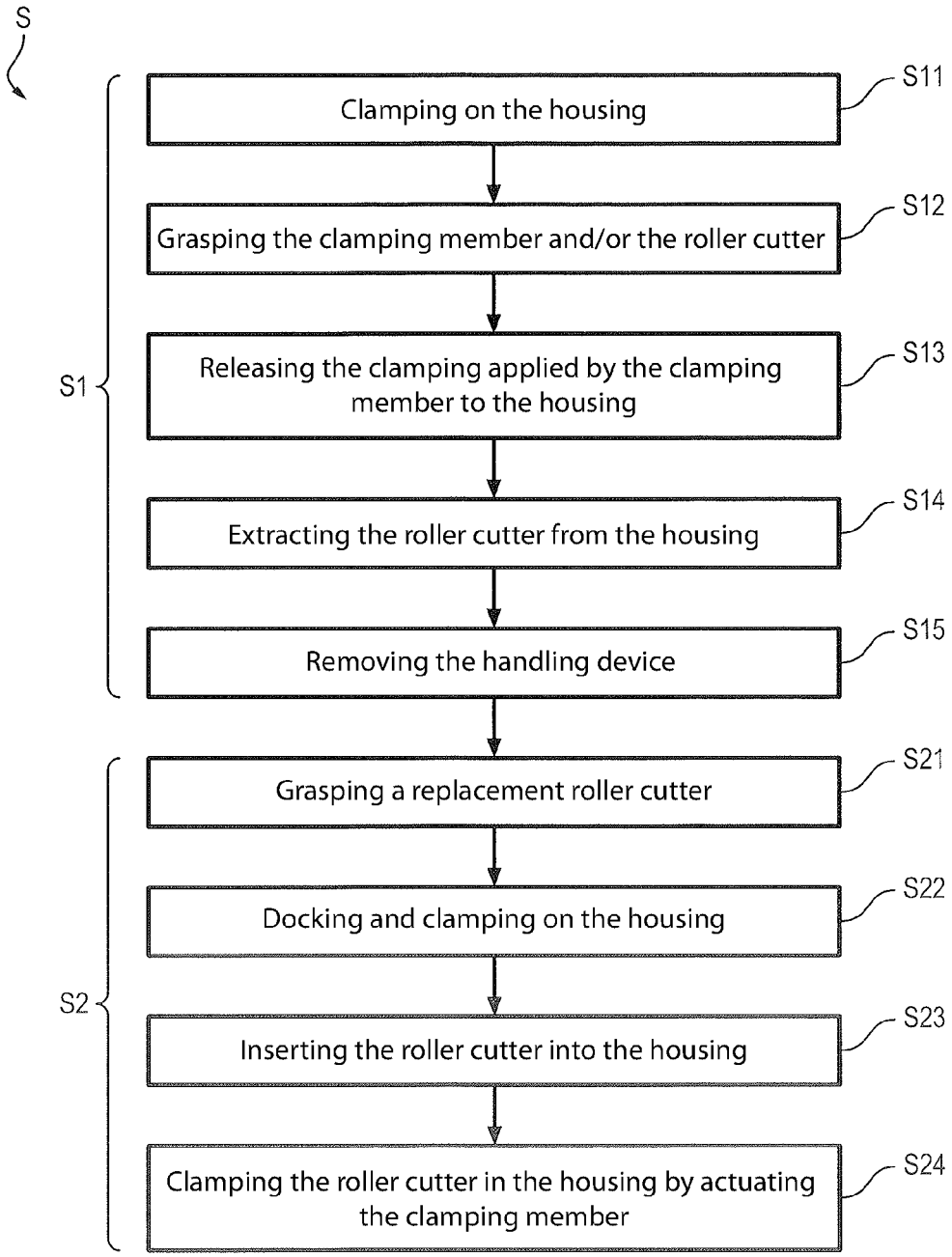
FIG. 7 is a flow chart representing different steps of an exemplary embodiment of the method for replacing a roller cutter of a cutting set for a tunnel boring machine in accordance with the invention.

A method S for replacing a roller cutter 10 in a holder 1, according to the invention, will now be described in reference to FIG. 7.

During the commissioning of the tunnel boring machine, each roller cutter 10 is installed in its housing 2 and is subject to preloading applied to the side wedges 36 by the actuator 38, which enables it to withstand the stresses to which it is subject during operation (i.e. during breaking operations). The reaction of this stress originates from the side faces of the base plate 32, thus creating a stress looping, perfectly immobilising the roller cutter 10 under load and when relaxing the cutting stresses (kick back). Furthermore, the variation in stress in the stud bolts remains much lower than their preloading value, which guarantees the absence of any unscrewing.

In a normal manner, the housing 2 is attached to the cutting head, typically via welding.

The replacement method S comprises a first step S1 for extracting the used roller cutter 10 from the housing 2 and a second step S1 for installing a replacement roller cutter 10 in the housing 2.

The extraction S1 of the used roller cutter 10 and the installation S2 of the replacement roller cutter 10 can take place in an automatic manner using a suitable handling device. The different parts of the clamping assembly 3 are bonded to each other and therefore captive. This embodiment is particularly advantageous in the case of confined face tunnel boring machines, as the working environment is under hyperbaric conditions. In such tunnel boring machines, the replacement of the roller cutter 10 is carried out, for safety reasons, from the rear of the cutting head, i.e. the side of the cutting head opposite the cutting face.

Alternatively, the extraction S1 and installation S2 steps can take place manually, either in whole or in part.

In the following paragraphs, the replacement method S will be described in the case of a cutting assembly 5 of a tunnel boring machine including a cutting holder 1 comprising two clamping assemblies 3 attached on either side of the roller cutter 10, each equipped with an actuator 38 comprising a sheath housing a stud bolt 39. Furthermore, each clamping assembly 3 comprises, as illustrated in FIGS. 4*a* and 4*b*, two side wedges 36 mounted in rotation on the base plate 32 and capable of being actuated by translation of the central wedge 34 by the actuator 38.

This however is in no way limitative insofar as the side wedges 36 could be mounted in rotation on the central wedge 34, the movement of which does not necessarily follow a translation movement, and/or the actuator 38 could comprise members other than a stud bolt 39 and a sheath 38.

The clamping and unclamping mechanism can therefore be actuated by simply screwing or unscrewing the actuators 38 of the clamping assemblies 3, which makes the implementation of the method particularly well suited to the use of an automatic handling device.

A used roller cutter 10 is extracted from its housing 2 according to the following steps.

In a first step S11, a roller cutter 10 handling device is brought to the housing 2 via the rear face 24 (i.e. the face opposite the cutting face) of the cutting head and attached to the housing 2 enabling extraction of the roller cutter 10.

For example, the handling device and the housing 2 can have respective recesses which cooperate to allow guidance and docking of the handling device on the housing 2.

The delivery of the handling device can be carried out in a semi-automated manner by means of a pulley block, or in a completely automated manner, through the use of a handling robot.

Once in position, locking elements of the handling device or of the carrying robot, can be actuated to lock the device onto the housing 2. These locking elements can consist of retaining pins movable through a quarter-turn, arranged on the handling device for holding suitable recesses provided on the housing 2.

In a second step S12, the handling device grasps the clamping assemblies 3 and/or roller cutter 10.

For this purpose, the handling device can include a grasping element arranged to allow for grasping of the roller cutter 10 and its safe indexing. Alternatively, the grasping element could grasp and index the clamping assemblies 3.

At this stage, the roller cutter 10 is still housed in the housing 2 and coupled in the latter.

Control devices can then draw alongside the case 2 then manoeuvre S13 the clamping sets 3 in order to move the side wedges 36 from their clamping position to their retracted position by bringing them close together thanks to the actuators 8. The roller cutter 10 and the clamping sets 3 are then disengaged from the case 2 and can be extracted S14 by an ejection effect generated by the end of the movement of maneuvering the clamping sets 3. This principle is not limited, as the ejection movement can also come from an additional actuator. This ejection movement can in particular be generated either by a bearing reaction on the structure of the cutting head integral with the case 2, or on the case 2, or by the device supporting the handling device.

So that the roller cutter 10 can be manipulated in order for it to be extracted S13, the set of elements integral with the roller cutter 10 must preferably be immobile in relation to one another in order to form a rigid block. For this purpose, the clamping sets 3 can be loaded in such a way that the parts of the clamping sets 3 become immobile in relation to one another, for example by maintaining the actuator 38 in position with regards to the base plate 30 while the side wedges 36 are in retracted position.

During the extraction S14, a relatively substantial effort may be required due to the over-centring that primarily results from the loads during operation that wedge the roller cutter 10 in its case 2.

The handling device of the roller cutter 10 therefore comprises extraction elements (for example cylinders or vibrators) which make it possible to exert the required extraction and pulling-off force. Where applicable, the over-centring can be reduced by forming clearance faces in the side walls 20 and the faces 21, 24 of the case 2 over the path of the roller cutter 10 during its extraction movement.

Finally, the handling device can be removed S15 and the assembly comprising the clamping sets 3 and the roller cutter 10 can be conveyed to the workshop where the used roller cutter 10 is removed.

Note that at any moment before, during or after the step of extraction S1, of the sub-phases of cleaning, for example by high pressure streams of water, can be implemented in such a way as to be able to provide for the cleanliness of the bearing phases of the cutter holder 1 during the reception of the new roller cutter 10.

It is furthermore possible to clean the handling device before it is used again in order to install a new roller cutter 10.

The installation S2 of a replacement roller cutter in the case 2 can be implemented during the following steps.

In a first step, in the workshop, the clamping sets 3 are fixed onto the roller cutter 10, for example by screwing the base plate 32 onto the side faces 12 of the roller cutter 10. The handling device can then grasp S21 the roller cutter 10 with the grasping element of the handling device mentioned hereinabove.

So that the roller cutter 10 can be manipulated, the various parts of the clamping sets 3 are preferably made immobile in relation to one another so that they constitute a rigid block. Moreover, the side wedges 36 are brought into retracted position, in order to not hinder the introduction of the roller cutter 10 into the case 2.

The handling device supporting the roller cutter 10 and the clamping sets 3 is then brought across from the rear face 24 of the case 2.

Once in centred position on the case 2, the handling device is clamped S22 onto the latter by its locking elements.

The grasping element of the handling device is then advanced S23 in order to insert the roller cutter 10 provided with the clamping sets 3 in the chamber 21 of the case 2 until it abuts against the front face 22 of the case.

Optionally, thanks to housings arranged in the internal faces of the side walls 20 of the case 2, the roller cutter 10 is automatically centred in relation to the latter. The form of the housings can furthermore be provided to procure bearing surfaces for the ends of the shaft of the roller cutter 10 in the front portion of the case 2. Moreover, the case 2 can furthermore comprise means 30 forming an abutment arranged in a zone adjacent to the front face 12, adapted to limit the course of the roller cutter 10 in the case 2 when it is inserted S23. For example, in FIGS. 4*a* and 4*b*, the means 30 forming an abutment comprise two screws, fixed in the opposite side walls 20 of the case 2 wherein are formed the cavities 26, in the vicinity of the front face 12. The screws 30 are configured to form a stop abutment and come into contact with the base plates 32 when the roller cutter 10 is inserted S23 into the case 32, which makes it possible to guarantee that the roller cutter 10 is not excessively advanced in relation to the front face 12 of the case and that the side wedges 36 are indeed across from their corresponding cavity 26.

In an embodiment, once the means 30 forming an abutment are reached by the roller cutter 10, the latter can be backed up slightly in order to not remain in contact with said means 30 when the entire cutter 5 is operating, and to avoid generating efforts that can interfere with the preload applied by the clamping sets in clamping position. Alternatively, this slight backing up can be generated by the profile of the bearings of the means 30 forming an abutment on the base plates 32.

Control devices can then draw alongside the case 2 then manoeuvre the clamping sets 3 in order to move the side wedges 36 from their retracted position to their clamping position S24 by having them swing transversally thanks to the actuators 8. For this purpose, a rotation effort is applied to the net 38, in order to bring it to the end of travel and to engage the side wedges 36 in the cavity 26 across from the case 2. Preferably, the torque applied by the rotation effort on the nut 38 in clamping position is sufficient for the side wedges 36 to apply a preloading to the case 2 that can withstand the severe vibrations, even in harsh terrain.

The roller cutter 10 and the clamping sets 3 are then engaged in the case 2 and are maintained firmly in this position.

The installation of the roller cutter 10 with preloading being completed, the handling device is then detached (control devices, grasping element and locking elements).

The invention claimed is:

1. A cutter holder for a tunnel boring machine, said cutter holder being adapted to accommodate a roller cutter freely rotatably mounted about an axis of rotation in said cutter holder and comprising:

a housing, defining a chamber arranged to accommodate the roller cutter, said housing comprising two cavities formed in opposite walls of the chamber, and two clamping sets, configured to be mounted on either side of the roller cutter removably in the housing, and each comprising:

a base plate, adapted to be attached to the roller cutter in the housing, said roller cutter remaining rotatably free about its axis of rotation, and a centre wedge and two side wedges, wherein, for each clamping set, the centre wedge is movably mounted on the base plate and in that both side wedges are mounted on the base plate and the centre wedge by being hinged thereto between a retracted position, wherein the side wedges are retracted and enable the clamping set to be removed from the housing, and a clamping position, wherein the side wedges swing and fit into the cavity facing the housing in order to prevent the clamping set from being extracted from the housing.

2. The cutter holder according to claim 1, wherein each clamping set further comprises a stud bolt, mounted on the base plate, and an actuating nut, mounted on the one hand on the centre wedge and on the other hand on the stud bolt, such that screwing or unscrewing said actuating nut causes the translation of the centre wedge with respect to the base plate and the side wedges to be moved between their retracted position and their clamping position.

3. The cutter holder according to claim 1, wherein:

the side wedges are rotatably mounted about an axis on the base plate or on the center wedge, and each comprise an actuation pin, and two guide grooves are formed in the center wedge or in the base plate respectively, said guide grooves defining cam surfaces for the actuating pins, each actuating pin being accommodated in a guide groove such that the movement of the centre wedge with respect to the base plate causes the movement of the actuating pin along the guide groove and thus the rotation of the side wedge with respect to the base plate between its retracted position and its clamping position.

4. The cutter holder according to claim 3, wherein the side wedges are rotatably mounted on the base plate and the guide grooves are formed in the centre wedge.

5. The cutter holder according to claim 3, wherein the axis of rotation of the side wedges is substantially parallel to the axis of rotation of the roller cutter.

6. The cutter holder according to claim 1, wherein the side wedges and the centre wedge comprise associated pressing faces, configured to be engaged when the side wedges are in the clamping position in order to withstand stains passing through the clamping sets and to provide a stable state to said clamping sets.

7. The cutter holder according to claim 1 wherein the side wedges extend substantially symmetrically with respect to the base plate.

8. The cutter holder according to claim 1, wherein the housing further comprises four further cavities each respectively in the opposite side walls between the cavities and the front face of the housing, each adapted to receive a further side wedge distinct from the clamping sets.

9. A clamping set of a cutter holder for a tunnel boring machine, configured to be removably mounted on either side of a roller cutter in a housing, and each comprising:

a base plate, adapted to be attached to the roller cutter in the housing, said roller cutter remaining rotatably free about its axis of rotation, and a centre wedge and two side wedges, wherein the centre wedge is movable mounted on the base plate and both side wedges are mounted on the base plate and the centre wedge by being hinged thereto between a retracted position, wherein the side wedges are retracted and enable the clamping set to be removed from the housing, and a clamping position, wherein the side wedges swing and fit into a cavity facing the housing in order to prevent the clamping set from being extracted from the housing.

10. A cutting set for a tunnel boring machine, comprising a roller cutter, attached in a cutter holder according to claim 1.

11. A method for replacing a roller cutter of a cutting set for a tunnel boring machine comprising a roller cutter attached in a cutter holder according to claim 1, said method comprising the steps of:

(iii) extracting a used roller cutter from the housing, comprising the following steps of:

docking and clamping on the housing of a handling device adapted for grasping and guiding the roller cutter, grasping the clamping set and/or the roller cutter by the handling device, releasing the clamping applied to the clamping set and the housing, extracting the roller cutter from the housing, removing the handling device from the housing, (iv) installing in said housing a replacement roller cutter, comprising the following steps of:

grasping the clamping set and/or the roller cutter by the handling device, docking and clamping the handling device on the housing, inserting the roller cutter into the housing, said roller cutter being guided by the handling device, operating the clamping set of the roller cutter, so as to accommodate the wedge in the cavity of the housing.

* * * * *